US011078707B2

(12) United States Patent
Friedrich et al.

(10) Patent No.: US 11,078,707 B2
(45) Date of Patent: Aug. 3, 2021

(54) SAFETY CONTACT STRIP

(71) Applicant: ASO GMBH ANTRIEBS-UND STEUERUNGSTECHNIK, Lippstadt (DE)

(72) Inventors: Helmut Friedrich, Lippstadt (DE); Nick Klause, Lippstadt (DE); Hubert Stroop, Guetersloh (DE)

(73) Assignee: ASO GmbH Antriebs- und Steuerungstechnik, Lippstadt (DE)

( * ) Notice: Subject to any disclaimer, the term of this patent is extended or adjusted under 35 U.S.C. 154(b) by 0 days.

(21) Appl. No.: 16/621,984

(22) PCT Filed: Apr. 23, 2018

(86) PCT No.: PCT/DE2018/000110
§ 371 (c)(1),
(2) Date: Dec. 12, 2019

(87) PCT Pub. No.: WO2018/228620
PCT Pub. Date: Dec. 20, 2018

(65) Prior Publication Data

US 2020/0149337 A1 May 14, 2020

(30) Foreign Application Priority Data

Jun. 12, 2017 (DE) ..... 10 2017 005 514

(51) Int. Cl.
*E05F 15/44* (2015.01)

(52) U.S. Cl.
CPC ..... *E05F 15/44* (2015.01); *E05Y 2800/455* (2013.01)

(58) Field of Classification Search
CPC ... E05F 15/44; E05Y 2800/455; H01H 3/161; H01H 2003/165
USPC ..... 200/61.43, 61.81, 61.82, 85 R, 52 R, 200/511–517; 49/26–28
See application file for complete search history.

(56) References Cited

U.S. PATENT DOCUMENTS

| | | | | |
|---|---|---|---|---|
| 3,118,984 | A * | 1/1964 | Koenig | H01H 3/142 200/61.43 |
| 4,532,388 | A | 7/1985 | Sackmann et al. | |
| 6,740,826 | B1 | 5/2004 | Friedrich et al. | |
| 7,282,879 | B2 | 10/2007 | Miller | |

(Continued)

FOREIGN PATENT DOCUMENTS

| | | | |
|---|---|---|---|
| DE | 3232365 | A1 | 3/1984 |
| WO | 0144611 | A2 | 6/2001 |

*Primary Examiner* — Edwin A. Leon
*Assistant Examiner* — Lheiren Mae A Caroc
(74) *Attorney, Agent, or Firm* — Laurence A. Greenberg; Werner H. Stemer; Ralph E. Locher

(57) ABSTRACT

A safety contact strip for a closing edge includes an inner shell facing the closing edge and being formed by a coextrudate of a first electrically insulating plastic. An outer shell spaced apart from the inner shell is formed by a coextrudate of a second electrically insulating plastic. Switching chambers respectively retained by at least one web between the inner and outer shells are formed with the outer shell. Two switching layers spaced apart from one another are formed in each switching chamber by a coextrudate of a third electrically conductive plastic. An electrical conductor is embedded in each of the switching layers as a further coextrudate.

12 Claims, 2 Drawing Sheets

(56) References Cited

U.S. PATENT DOCUMENTS

| | | | | |
|---|---|---|---|---|
| 8,493,081 | B2 * | 7/2013 | Bolbocianu | E05F 15/443 324/691 |
| 2013/0307567 | A1 * | 11/2013 | Bolbocianu | G01D 11/30 324/661 |
| 2019/0390501 | A1 * | 12/2019 | Kawase | E05F 15/44 |

* cited by examiner

SAFETY CONTACT STRIP

BACKGROUND OF THE INVENTION

Field of the Invention

The invention relates to a safety contact strip for a closing edge.

Safety contact strips are routinely used at squeeze and shear points, for example at gates, doors, machines, and handling devices, to protect persons and material.

A safety contact strip known from WO 2001/044611 A2 is retained on a fastening side in a carrier profile, which can be attached to a closing edge. This known safety contact strip has two electrically conductive switching layers in a non-conductive, closed switching chamber within an outer shell of a profile, wherein, in a cross section, the switching chamber is kept free from webs formed in a spoke-like manner.

The profile, the switching chamber, and the webs of a first, non-conductive plastic, and the switching layers of a second, electrically conductive plastic, each comprising at least one embedded metal conductor, are formed in one piece by a coextrudate.

The safety contact strip known from WO 2001/044611 A2 switches highly reliably in response to a contact, but, due to the design, no statements can be made as to the direction of a force, which triggers a switching process and which acts on the safety contact strip.

This is possible in the case of a safety contact strip known from U.S. Pat. No. 7,282,879 B2. This safety contact strip, which is profiled in a C-shaped or U-shaped manner, can for example encompass the closing edge of a gate, which swings about an axis, and the direction of a stress causing a switching process can be determined by means of the formation of two electrical switching elements, in each case oriented in the direction of movement of the gate.

However, the formation of the safety contact strip as a whole and in particular the formation of the switching elements, is highly multipartite and complex. In addition, the determination of the direction of a stress triggering a switching process is only possible in the direction of movement of the gate.

SUMMARY OF THE INVENTION

In light of the foregoing, the invention has the object of providing a safety contact strip, which switches exactly and which is structurally simple and mechanically stable.

This technical problem is solved by a safety contact strip for a closing edge, comprising an inner shell facing the closing edge and being formed by a coextrudate of a first electrically insulating plastic, an outer shell spaced apart from the inner shell and being formed by a coextrudate of a second electrically insulating plastic, switching chambers each being retained by at least one respective web between the inner and outer shells and being formed with the outer shell, two switching layers being spaced apart from one another and formed by a coextrudate of a third electrically conducive plastic in each switching chamber, and electrical conductors each embedded as a further coextrudate in a respective one of the switching layers. The subclaims represent advantageous further developments.

One advantage of the safety contact strip according to the invention is that it is a one-piece coextrudate of various plastics, both electrically insulating and electrically conductive, and electrical conductors.

The inner shell preferably serves for the contact and the fastening directly to the closing edge, but optionally also for a fastening by means of a fastening profile, and is thus dimensionally stable to a large extent. In contrast, the outer shell, which is spaced apart from the inner shell, can be deformed in response to striking an obstacle. In the case of a sufficient size of the deformation, a switching signal is triggered by means of one or a plurality of switching chambers by means of such a deformation of the outer shell with respect to the essentially defined inner shell, in that the switching layers contact one another in such a chamber.

Electrical conductors are also embedded in a manner, which is known per se, in the electrically conductive plastic of the two switching layers of a switching chamber.

In the case of the safety contact strip according to the invention, a plurality of, preferably three, switching chambers are further provided. Due to this measure, it is possible due to the interconnection of the switching chambers, when striking an obstacle, to generate a common signal or several, which, when evaluated accordingly, also allow making a statement about the direction of the stress of the safety contact strip.

This is useful in particular when the safety contact strip has a profile, which encompasses the closing edge, and is profiled for example in an L-shaped, C-shaped or U-shaped manner for this purpose, in order to also encompass a post, for example.

The responsiveness of the switching chambers is essentially influenced by the suspension thereof on the webs between the inner and the outer shell. It turned out to be useful, when it is provided that an individual web, the central plane of which is perpendicular to the inner surface of the outer shell, is provided between the outer shell and a switching chamber.

The switching layers are then preferably oriented essentially perpendicular to this central plane, so that, in the case of a sufficiently stiff formation of this web, the outer switching layer, which is adjacent to the outer shell, will largely follow the change in position of said web in response to a deformation of the safety contact strip.

As a result of this measure, the position of the connection of the switching chamber to the outer shell will hardly change, while the deformation of the switching chamber, which is necessary for a switching process, then essentially takes place with respect to the inner shell.

This is why it is further provided that at least one further web is provided between the inner shell and a switching chamber, and that the individual web between the outer shell and the switching chamber is formed to be stiff with respect to the further web or webs between the switching chamber and the inner shell.

The connection of the switching chamber to the inner shell preferably takes place via two webs, which run symmetrically to a central plane of the individual web in the non-deformed state. A preferred direction for a switching of the switching chamber is avoided thereby.

In addition to the suspension of the switching chamber on the webs between the outer and the inner shell, the geometry of the switching layers is significant for the exact switching of the safety contact strip according to the invention.

It is thus provided that, in a cross section, a first, outer switching layer is formed in a conical manner, that the second, inner switching layer has a concave contact surface, into which the first switching layer can dip, that the second switching layer has notches enclosing the first switching layer, and that the central plane of the first switching layer, unstressed, is perpendicular to the second switching layer.

The first switching layer is thereby preferably further rounded on its free end, so that a contact surface, which extends somewhat linearly, is formed.

The second switching layer, in contrast, has a concave contact surface, by means of which the first switching layer, which is formed in a conical manner, is quasi enclosed in response to a deformation of the switching chamber. Such an enclosing is facilitated by the notches, which, to a certain extent, also allow for a deformation of the second switching layer in response to a deformation of the switching chamber.

The outer and the inner shell are retained spaced apart from one another not only by means of the switching chambers, which are retained by webs, but also by means of intermediate walls. A structural design thus provides that intermediate walls are formed between the outer and the inner shell, the cross section of which tapers towards the inner shell, by the coextrudate of the second plastic. The deformation of the safety contact strip as a whole is also shifted to the inner shell by means of this measure.

So that, viewed in a cross section, a balanced switching behavior is also ensured in the area of the left or right ends, respectively, of the safety contact strip, which is enclosing a closing edge, it is further provided that the section, which faces the closing edge and closes the space between inner and outer shell, of the coextrudate of the second plastic runs in a curved manner in the shape of an S.

Such a formation of the end sections of the safety contact strip according to the invention further allows in a simple manner that the inner shell protrudes beyond the section, which closes the space between inner and outer shell, with a lug. Such a lug in particular also serves to secure the inner shell to the closing edge, for example also by means of screws. This is very simple, when the lug is provided with a groove in the longitudinal extension of the safety contact strip, in which such screws can be attached.

In a further structural design of the safety contact strip, it is provided that two buffers, which protrude beyond the inner shell and enclose a switching chamber, are formed by the coextrudate of the first plastic. It is thereby in particular envisaged that, in response to a linear closing movement of the closing edge, a switching chamber, which is enclosed by such buffers, is arranged centrally upstream of the closing edge in the direction of the closing movement. When the safety contact strip strikes an object at a high speed in response to a closing of the closing edge, this front-side switching chamber is largely protected against damages.

It can thereby be provided in an exemplary manner that the first plastic has a smaller Shore hardness than the second plastic, wherein it is in particular envisaged that the first plastic has a Shore D hardness of between 30 and 50, and that the second plastic has a Shore A hardness of between 35 and 55.

BRIEF DESCRIPTION OF THE SEVERAL VIEWS OF THE DRAWING

The invention will be described in more detail on the basis of the drawing, in which only two preferred exemplary embodiments are illustrated. In the drawing.

DESCRIPTION OF THE INVENTION

Figure 1:
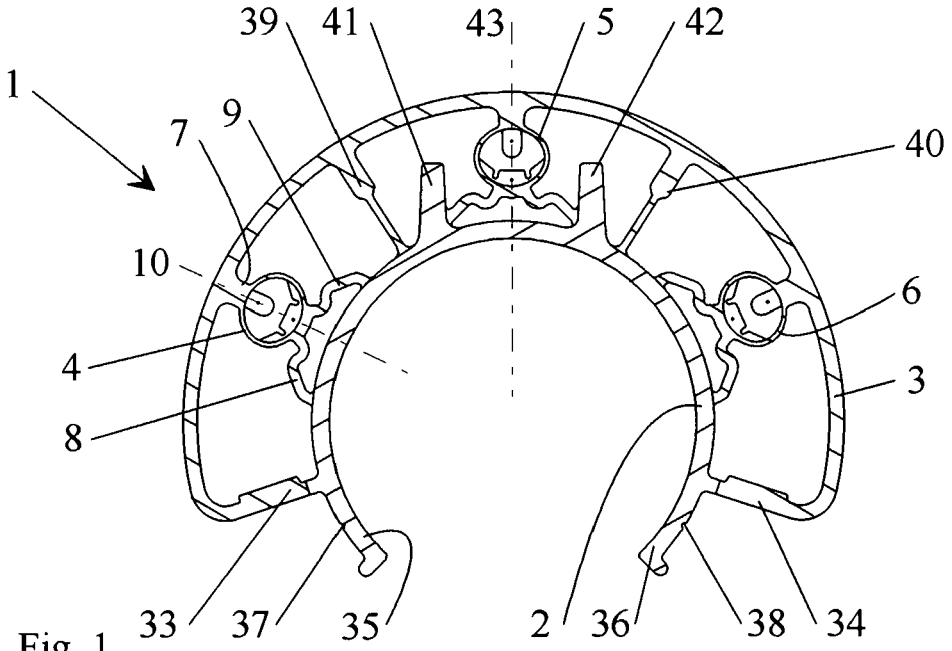
FIG. 1: shows a safety contact strip, which is profiled in a C-shaped manner, in a cross section.

The safety contact strip 1 according to FIG. 1, which is profiled in a C-shaped manner, is intended for example for engaging around a round end post of a gate comprising a round cross section. For this purpose, the elasticity of the used plastics allows a sufficient widening of the opening of an inner shell 2. After applying the safety contact strip 1 to such a closing edge, the inner shell 2, however, should abut as exactly as possible on the closing edge.

The inner shell 2 of a first electrically insulating plastic is enclosed by an outer shell 3 of a second plastic, which is also electrically insulating, in a coaxial arrangement. The inner and the outer shell 2, 3 are a coextrudate.

In the case of the exemplary embodiment, three switching chambers 4-6 are provided between the inner and the outer shell 2, 3.

Each of the switching chambers 4-6 is retained here on three webs 7-9 in the space between the inner and the outer shell 2, 3. The individual web 7 between the outer shell 3 and the switching chamber 4 is formed to be comparatively massive and stiff as compared to the two other webs 8, 9 between the switching chamber 4 and the inner shell 2.

The two webs 8, 9 between the switching chamber 4 and the inner shell 2 are formed symmetrically to a central plane 10 through the web 7.

The outer shell 3, the switching chambers 4-6, and the webs 7-9 are formed by a coextrudate of a second electrically non-conductive plastic.

Figure 3:
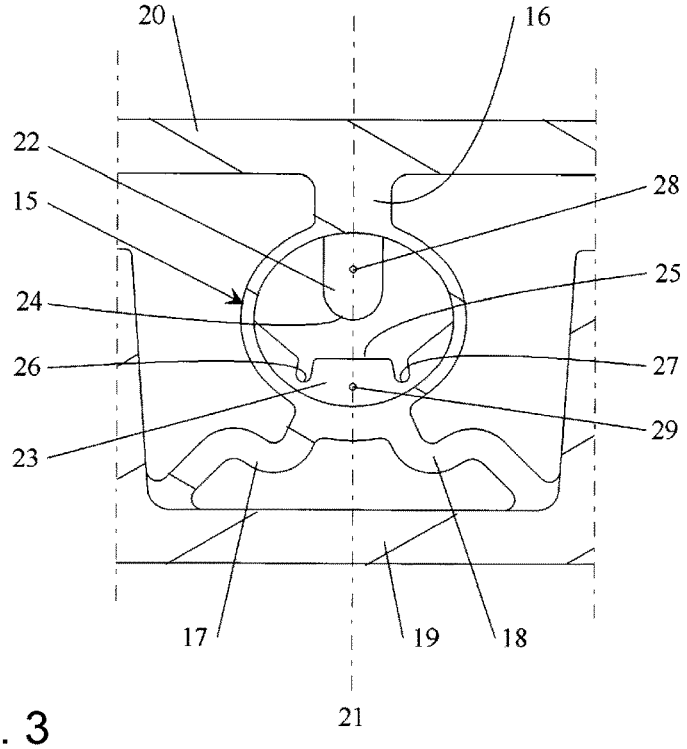
FIG. 3: shows an enlarged illustration of a switching chamber.

The setup of the switching chambers 4-6 is identical and will be further described in FIG. 3 on the basis of the enlarged illustration of a switching chamber 15.

The switching chamber 15, which is retained between the inner shell 19 and the outer shell 20 by means of the webs 16-18, as well as the webs 17, 18 are formed symmetrically to a central plane 21 through the web 16.

Two switching layers 22, 23 located opposite one another, each of an electrically conductive plastic, as coextrudate comprising the first and the second plastic are introduced in the switching chamber 15. In the illustrated cross section, the outer switching layer 22 with respect to the encompassed closing edge is formed conically comprising a rounded contact surface 24.

The central plane 21 through the cone 16 is perpendicular to the contact surfaces 24, 25 of the first and second switching layer 22, 23. The contact surface 25 of the second switching layer 23 is formed essentially concave so that, in response to a deformation of the switching chamber 15, the outer switching layer 24, which is formed in a conical manner, can quasi be enclosed by the second switching layer. So that such an enclosing movement is facilitated, two notches 26, 27, which enclose the conical switching layer 24, are also introduced into the switching layer 23.

Two electrical conductors 28, 29 are also introduced into the two switching layers 22, 23.

The safety contact strip 1 is thus a coextrudate of two electrically non-conductive plastics, six strands of electrically conductive plastics in the three switching chambers 4-6, comprising six electrical conductors, which are likewise coextruded.

In the case of the exemplary embodiment of the safety contact strip 1 according to FIG. 1, the central planes 10 of the switching chambers 4-6 intersect in the central point of the circle, which is spanned by the inner shell 2. Orientations of the switching chambers 4-6, which differ therefrom, are possible without any problems.

In the case of the exemplary embodiment of the safety contact strip 1 according to FIG. 1, the curve of the outer shell 3 is furthermore dimensioned to be smaller than the curve of the inner shell 2. As a result, the inner shell 2 protrudes beyond sections 33, 34, which close the space between the inner shell 2 and the outer shell 3, with two lugs 35, 36, which serve, for example, for fastening the safety contact strip 1 to a post and which are provided with grooves 37, 38 running along the safety contact strip 1 for an easy attachment of, for example, screws.

Two intermediate walls 39, 40, which taper towards the inner shell 2 in a cross section, are also extruded by means of the first plastic of the outer shell 3.

By means of the first plastic of the inner shell 2, two buffers 41, 42 are further formed, which, in response to a larger deformation of the safety contact strip in response to a linear movement along the axis of symmetry of the safety contact strip 1 and central plane 43 of the switching chamber 5, enclose and protect the latter.

The two switching layers of the switching chambers 4-5 can be connected in series in such a way that, in response to a stress and triggering of an arbitrary switching strip 4-5, only a single switching signal is generated. However, a detection of the direction of a stress is then not possible.

In the alternative, however, a determination of the direction of a stress of the safety contact strip 1 is also possible. With reference to FIG. 1, the response from the switching chamber 4 will detect a stress, which occurs essentially from the left, the switching chamber 5 a stress from the front or from the top, respectively, and the switching chamber 6 a stress from the right. If the front switching chamber 5 and one of the other switching chambers 4, 5 also respond, a stress occurs diagonally from the front.

Figure 2:
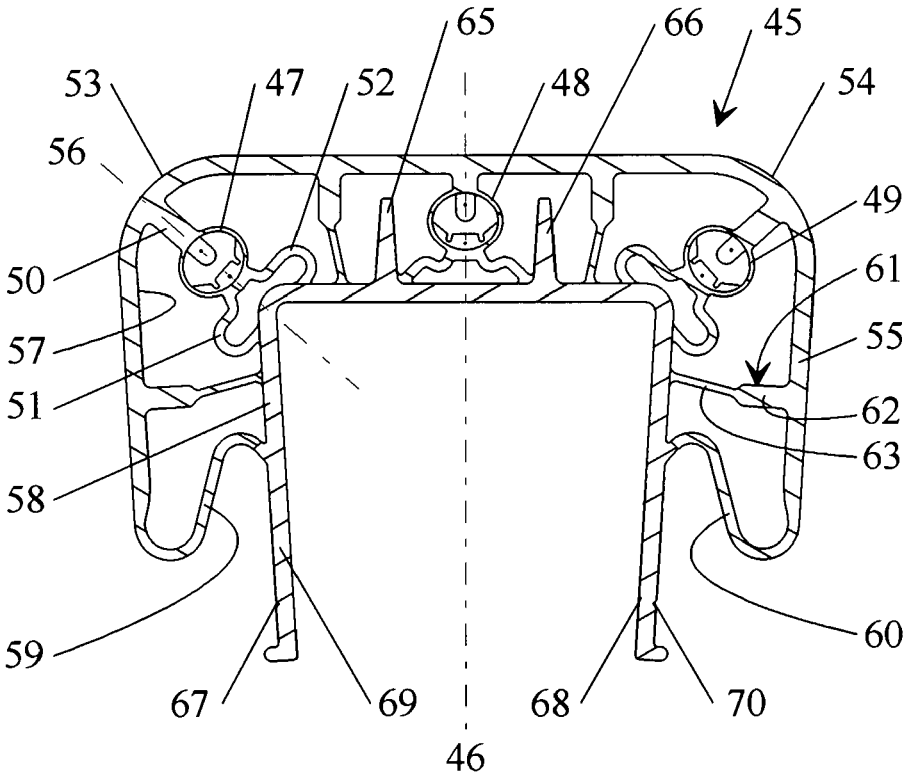
FIG. 2: shows a contact strip, which is profiled in a U-shaped manner.
Figure 4:
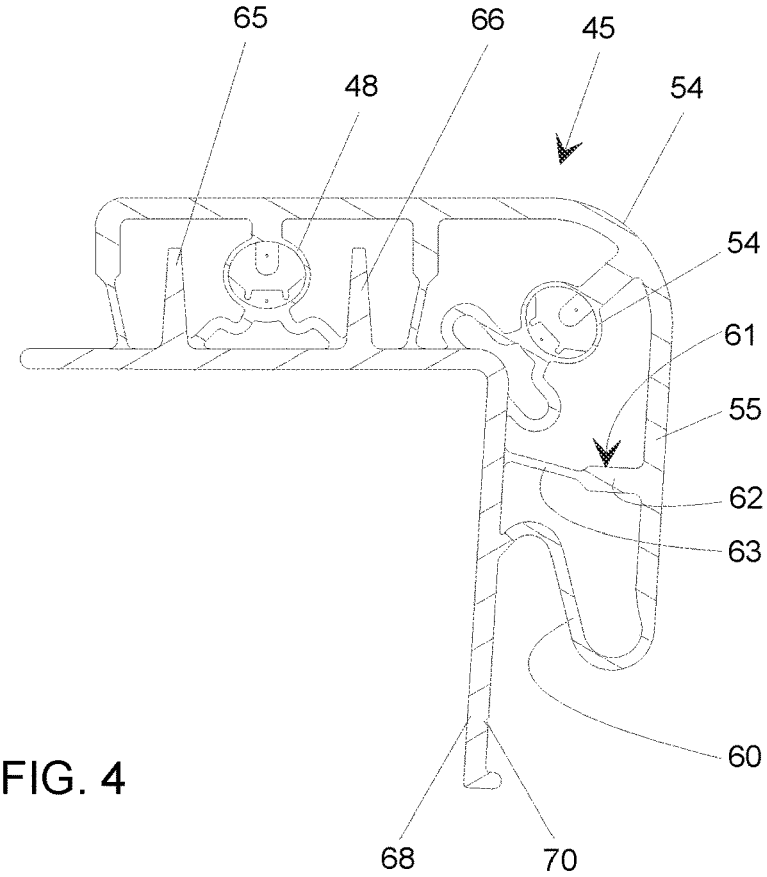
FIG. 4: shows an illustration similar to FIG. 2, in which the safety contact strip has an L-shaped profile.

The safety contact strip 45 according to FIG. 2 is profiled in a U-shaped manner and the safety contact strip 45 according to FIG. 4 is profiled in an L-shaped manner in the illustrated cross section, but the technical setup thereof essentially corresponds to the safety contact strip 1 according to FIG. 1. The safety contact strip 45, in the same way as the safety contact strip 1, is thus symmetrical to a central plane 46, which extends in the direction of a linear closing movement of a closing edge enclosed by the safety contact strip 45.

The safety contact strip 45 also has three switching chambers 47-49, which are in each case retained by three webs 50-52. Due to the roundings 53, 54 of the outer shell 55, the central planes 56 of the webs 50 of the switching chambers 47, 49 are perpendicular to the inner surface 57 of the outer shell 55.

The sections 59, 60, which face the closing edge and which close the space between inner and outer shell 58, 55, and which, in the case of this exemplary embodiment of a safety contact strip 45, are curved in an S-shaped manner, are also formed by means of the plastic material of the outer shell 55.

Intermediate walls 61, in the case of this exemplary embodiment a total of four, of which a first section 62, which adjoins the outer shell 55, is perpendicular to the inner surface 57, are formed by means of the second plastic of the outer shell 55. Starting at the inner shell 58, a second section 63 of a smaller material thickness adjoins the first section 62 at an angle of attack.

According to the first exemplary embodiment of a safety contact strip 1, two buffers 65, 66 of the first plastic of the inner shell 58 also enclose the switching chamber 48.

For a fastening to a closing edge, the lugs 67, 68 of the inner shell 58, which protrude beyond the sections 59, 60, as in the first exemplary embodiment, also have grooves 69, 70, which run along the safety contact strip 45.

The invention claimed is:

1. A safety contact strip for a closing edge, the safety contact strip comprising:

an L-shaped, C-shaped or U-shaped profile of the safety contact strip for at least partially encompassing the closing edge;

an inner shell facing the closing edge, said inner shell being formed by a coextrudate of a first electrically insulating plastic;

an outer shell spaced apart from said inner shell, said outer shell being formed by a coextrudate of a second electrically insulating plastic;

webs disposed between said inner and outer shells;

switching chambers formed with said outer shell, each of said switching chambers being retained by at least one of said webs;

mutually spaced-apart switching layers formed by a coextrudate of a third electrically conducive plastic, each of said switching chambers receiving a respective two of said switching layers; and electrical conductors each being embedded as a further coextrudate in a respective one of said switching layers.

2. The safety contact strip according to claim 1, wherein said switching chambers are interconnected and upon striking an obstacle cause a common signal to be generated, or an evaluation of individual signals of said switching chambers allows a statement to be made about a direction of a stress of the safety contact strip when striking an obstacle.

3. The safety contact strip according to claim 1, wherein said webs include an individual web disposed between said outer shell and one of said switching chambers, said individual web having a central plane being perpendicular to an inner surface of said outer shell.

4. The safety contact strip according to claim 3, wherein:

said webs include at least one further web disposed between said inner shell and one of said switching chambers; and said individual web disposed between said outer shell and said one switching chamber is stiffer than said at least one further web disposed between said one switching chamber and said inner shell.

5. The safety contact strip according to claim 1, wherein:

said two switching layers include a first outer switching layer having a conical cross section and a second inner switching layer having a concave contact surface into which said first switching layer can dip;

said second switching layer having notches enclosing said first switching layer; and said first switching layer having a central plane being perpendicular to said second switching layer in an unstressed state.

6. The safety contact strip according to claim 1, which further comprises intermediate walls formed by the coextrudate of the second plastic, said intermediate walls being disposed between said outer and inner shells, and said intermediate walls having a cross section tapering towards said inner shell.

7. The safety contact strip according to claim 1, which further comprises a curved S-shaped section of the coextrudate of the second plastic facing the closing edge and closing a space between said inner and outer shells.

8. The safety contact strip according to claim 7, wherein said inner shell has a lug protruding beyond said section closing said space between said inner and outer shells.

9. The safety contact strip according to claim 8, wherein said lug has a groove in a longitudinal extension of the safety contact strip.

10. The safety contact strip according to claim 1, which further comprises two buffers formed by the coextrudate of the first plastic, said two buffers protruding beyond said inner shell and enclosing one of said switching chambers.

11. The safety contact strip according to claim 1, wherein the first plastic has a smaller Shore hardness than the second plastic.

12. The safety contact strip according to claim 11, wherein the first plastic has a Shore D hardness of between 30 and 50 and the second plastic has a Shore A hardness of between 35 and 55.

* * * * *